US009931536B2

(12) United States Patent
Azevedo et al.

(10) Patent No.: US 9,931,536 B2
(45) Date of Patent: Apr. 3, 2018

(54) HIP HARNESS

(71) Applicants: Emily Azevedo, Chico, CA (US); Curtis Tomasevicz, Colorado Springs, CO (US)

(72) Inventors: Emily Azevedo, Chico, CA (US); Curtis Tomasevicz, Colorado Springs, CO (US)

(73) Assignees: Emily Azevedo, Chico, CA (US); Curtis Tomasevicz, Colorado Springs, CO (US)

( * ) Notice: Subject to any disclaimer, the term of this patent is extended or adjusted under 35 U.S.C. 154(b) by 674 days.

(21) Appl. No.: 13/839,016

(22) Filed: Mar. 15, 2013

(65) Prior Publication Data

US 2014/0081185 A1 Mar. 20, 2014

Related U.S. Application Data

(60) Provisional application No. 61/701,466, filed on Sep. 14, 2012.

(51) Int. Cl.
*A63B 23/00* (2006.01)
*A63B 69/00* (2006.01)
(Continued)

(52) U.S. Cl.
CPC ..... *A63B 23/00* (2013.01); *A63B 21/065* (2013.01); *A63B 21/4009* (2015.10);
(Continued)

(58) Field of Classification Search
CPC ..... A63B 21/00152; A63B 21/0603; A63B 21/0607; A63B 21/065; A63B 21/1419;
(Continued)

(56) References Cited

U.S. PATENT DOCUMENTS 4,901,710 A * 2/1990 Meyer ..... A61F 5/0193 602/24
6,210,353 B1 * 4/2001 Barnes ..... A61F 5/0193 602/19
(Continued)

*Primary Examiner* — Rachel T Sippel
(74) *Attorney, Agent, or Firm* — Kristin Mazany Nevins; Offit Kurman

(57) ABSTRACT

This application discloses a hip joint apparatus, or hip harness, configured to align with the femoral head of a user's hip joint for application of pressure, while maintaining proper anatomic position of the femoral head—i.e., aligned behind the actalum—which in turn helps reduce the incident of labral tears and irritation caused when the user squats or lunges too deeply. Thus, the hip harness helps hold the femur head posteriorly from shifting forward during a squat or deep lunge, which in turn, may help to prevent labral tears and irritation. The hip harness apparatus comprises a primary waist belt configured for adjustable attachment around a waist of a user; a secondary thigh belt configured for adjustable attachment around the upper portion of a user's thigh; and a pressure pad, wherein the pressure pad is configured for adjustable attachment with the secondary thigh belt and wherein the pressure pad is configured in shape and size to abut a femoral head of an anterior portion of the user's hip joint.

8 Claims, 5 Drawing Sheets

(51) Int. Cl.

| | |
|---|---|
| ***A63B 71/00*** | (2006.01) |
| ***A63B 71/08*** | (2006.01) |
| ***A63B 21/06*** | (2006.01) |
| ***A63B 23/04*** | (2006.01) |
| ***A63B 21/065*** | (2006.01) |
| ***A63B 21/00*** | (2006.01) |

(52) U.S. Cl.
CPC ..... *A63B 23/0405* (2013.01); *A63B 69/0059* (2013.01); *A63B 71/0054* (2013.01); *A63B 71/08* (2013.01); *A63B 21/0603* (2013.01); *A63B 21/0607* (2013.01); *A63B 2023/0411* (2013.01); *A63B 2071/0072* (2013.01); *A63B 2209/10* (2013.01)

(58) Field of Classification Search
CPC ..... A63B 22/0285; A63B 2022/0292; A63B 23/00; A63B 23/0405; A63B 23/0411; A63B 23/0402; A63B 69/0059; A63B 2069/0062; A63B 71/0054; A63B 71/08; A63B 2071/0072; A61H 11/00; A61H 2011/005; A61H 2201/0173; A61H 2201/018; A61H 2201/1628–2201/163; A61H 2201/165–2201/1652; A61H 2205/10; A61F 2/605; A61F 2002/7862; A61F 5/01–5/0104
See application file for complete search history.

(56) References Cited

U.S. PATENT DOCUMENTS

| | | | | |
|---|---|---|---|---|
| 8,056,675 | B2 * | 11/2011 | Helms | A62B 35/0018 182/134 |
| 2003/0015905 | A1 * | 1/2003 | Sappei | A62B 35/0031 297/468 |
| 2005/0192159 | A1 * | 9/2005 | Jackson | A45F 3/14 482/23 |
| 2007/0027419 | A1 * | 2/2007 | Drennan | A61F 5/0193 602/19 |
| 2010/0048363 | A1 * | 2/2010 | Gilberti | A63B 21/0603 482/105 |
| 2010/0093504 | A1 * | 4/2010 | Del Monte | A63B 21/065 482/105 |
| 2010/0292622 | A1 * | 11/2010 | Weissleder | A61F 5/0193 602/23 |

* cited by examiner

HIP HARNESS

CROSS-REFERENCE TO RELATED APPLICATIONS

This application claims the benefit of U.S. Provisional Patent Application No. 61/701,466, filed on 14 Sep. 2012, entitled "Hip Harness", the entirety of which is hereby incorporated by reference.

BACKGROUND

The primary function of the hip joint is to support the weight of the body in both static (e. g. standing) and dynamic (e. g. walking or running) postures. The hip joints are the most important part of the body in retaining balance. The pelvic inclination angle, which is the single most important element of human body posture, is adjusted at the hips. It is no wonder then, that injury of the hip joint can be painful and debilitating.

The hip joint, scientifically referred to as the acetabulo-femoral joint, is the joint between the femur and acetabulum of the pelvis. The femur head is globular and forms rather more than a hemisphere, is directed upward, medial-ward, and a little forward, the greater part of its convexity being above and in front. The head of the femur meets with the pelvis at the acetabulum, forming the hip joint.

Three bones come together to form the acetabulum; the ischium; the ilium; and the pubis. The acetabulum is also home to the acetabular notch, an attachment site for ligaments that hold the head of the femur securely in the acetabulum. The well-fitting surfaces of the femoral head and acetabulum, which face each other, are lined with a layer of cartilage and lubricated by a thin film of fluid. Friction inside a normal hip is less than one-tenth that of ice gliding on ice, however, friction increases as the cartilage and ligaments are damaged due to injury.

The hip muscles act on three mutually perpendicular main axes, all of which pass through the center of the femoral head, resulting in three degrees of freedom and three pair of principal directions: Flexion and extension around a transverse axis (left-right); lateral rotation and medial rotation around a longitudinal axis (along the thigh); and abduction and adduction around a sagittal axis (forward-backward); and a combination of these movements (i. e. circumduction, a compound movement in which the leg describes the surface of an irregular cone).

Athletes can experience hip pain as a result of many conditions: bone fractures; muscle strains and tendinitis (iliopsoas and proximal hip quadriceps strains; iliotibial (IT) band syndrome; muscle tendon bursitis; contusion (bruise, commonly called a hip "pointer"); labral tears of cartilage; osteoarthritis; and emoroacetabular impingement (FAI, a condition where the bones of the hip are abnormally shaped, and rub against each other and cause damage to the joint).

Hip fractures commonly involve a bone break just below the femur head. Such fractures are rare in young people and tend to be caused by falls, car accidents and sports injuries. Symptoms include pain, stiffness, and loss of strength and range of motion. Muscle strains and tendinitis arise when muscles and tendons of the hip and groin region are subject to overuse injuries. Symptoms include aches, stiffness, and pain in the front or back of the hip when one tries to flex the hip while running or kicking. IT band syndrome results when the belt of fibrous tissue that runs along the outside of the hip to the knee becomes too tight and rigid. When the knee is flexed, the IT band grates against the edge of the hip bone, causing irritation. The pain is usually felt outside the hip and along the knee, especially with walking and running. Bursitis arises when the bursa sacs and other soft tissue around the hip become inflamed and painful, especially with walking and running. Pain is often experienced when lying on the affected side of the body. Hip "pointer" injuries often occur during football or hockey, when an impact to the rim of the pelvis results in internal bleeding. Pain and soreness are experienced on the side of the hip and may make walking or skating difficult. The injury can be visible—swollen and bruised. Labial tears cause pain in the hip and may be accompanied by a clicking sound (with movement). When these tears occur in athletes, their ability to run and jump is significantly limited. Osteoarthritis, essentially hip pain that persists, may signal arthritis, especially in older athletes. Limping while walking is also a common hip complaint and may be related to stiffness and pain in the hip joint. Eventually, there may be nothing left to prevent direct bone-on-bone friction within the joint, which causes pain with movement and weight-bearing activities.

Sports-related hip pain is usually the result of a traumatic event, such as when someone falls or sustains a hard impact. Such pain also may stem from extensive, repetitive motion. Hip injuries may also happen with a single event of too much strain or stress to the joint. Most sports-related hip problems will typically respond to conservative treatment. Surgery rarely is needed for general hip injuries. Labral tears may require arthroscopy and hip or femur fractures likely need surgical repair. Most hip fractures will require surgery to stabilize the joint. The extent of surgery depends on the exact fracture. Muscle strains, tendonitis, bursitis, and iliotibial band syndrome can be managed through non-surgical methods. Hip "pointer" treatment will usually require activity modification and padding until the bruise, or hematoma, resolves. Labral tear is treated by arthroscopic surgery. Osteoarthritis treatment will depend on the extent of arthritis in the joint and its impact on function. Non-operative treatments include: modifying activity, icing, medication, and/or rehabilitation.

Another non-operative treatment for hip injury and hip-injury related pain is use of a hip brace. Hip braces are commonly employed both to prevent hip-joint injury and alleviate pain. Hip braces of the prior art are designed to support the hip and hip-joint by aligning the hip in a certain orientation or by restricting joint or hip motion. This is often accomplished through the use of multiple straps, or rigid or semi-rigid, materials that help align the hip in a certain orientation, thereby immobilizing the hip joint.

SUMMARY OF THE INVENTION

Described herein is a hip harness designed with a unique pressure-point feature for use by athletes or persons engaged in exercise. The hip harness described herein provides a method of restraining the femoral head of a user's hip/thigh area when performing exercises, which require deep-hip flexion, such as squats or lunges. In one embodiment, the user can control the amount of pressure on the thigh/hip area by adjusting the pressure-point feature.

In one embodiment, the harness may include two belts: a primary waist belt, and a secondary thigh strap/belt. The primary belt may adjustably secure around a waist of a user. The secondary belt may adjustably secure around the upper-anterior-portion of a user's thigh. The secondary belt may be removably secured to the primary belt to maintain the position of the secondary belt.

The secondary belt may include a pressure-point feature, such as a pressure pad, adjustably configured to abut the anterior-portion of a user's hip joint. Specifically, in one example, the pressure pad is configured in shape and size to abut against the femoral head, and is adjustable in relation to its position relative to the secondary belt. The pressure pad with the primary and secondary belts help keep the femoral head posterior in the acetabulum, if the user squats or lunges, thus, alleviating pressure on the labrum on the anterior side of the hip socket; and limit the depth of a squat or lunge.

DETAILED DESCRIPTION

Reference herein to "one embodiment", "an embodiment", or similar formulations, means that a particular feature, structure, operation, or characteristic described in connection with the embodiment, is included in at least one embodiment of the present invention. Thus, the appearance of such phrases, or formulations herein, are not necessarily all referring to the same embodiment. Furthermore, various particular features, structures, operations, or characteristics may be combined in any suitable manner in one or more embodiments.

Figure 1:
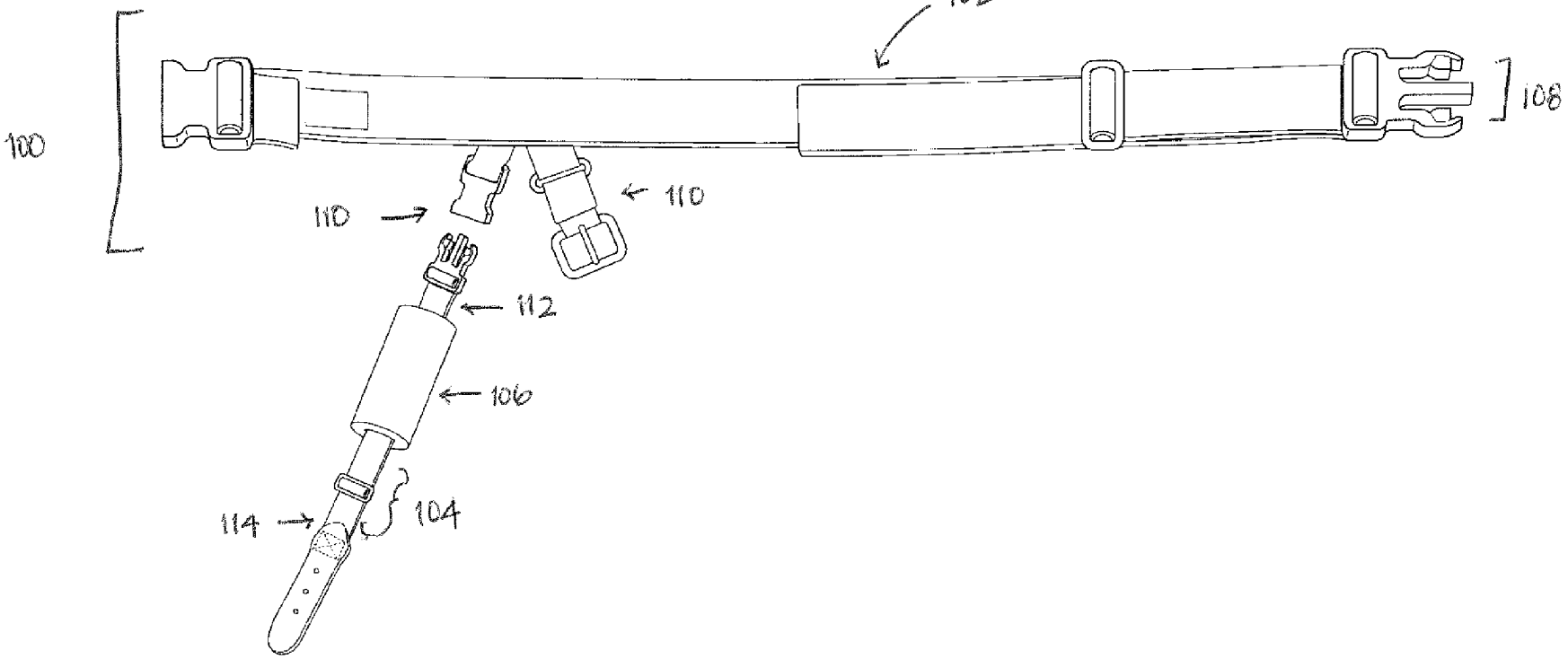
FIG. 1 shows a front view of one embodiment of the hip harness with pressure-point feature.

The hip harness described herein provides comfortable and effective support to the femoral head of the hip joint. FIG. 1 shows one embodiment of hip harness 100. Hip harness 100 is comprised of a waist belt 102, a thigh strap 104, and a pressure point feature 106. Waist belt 102 further comprises belt closure means 108. In FIG. 1, waist belt closure means 108 are shown as a plastic clip fastener, which secures the ends of the belt together, but it will be appreciated by those skilled in the art having the benefit of this disclosure, that various other suitable closure means can be sued, such as belt buckles, ties, snaps, hook and loop, Velcro, and any combinations thereof.

In one embodiment, waist belt 102 is a strap of sufficient length to fit around the waist of a user, but can be of various lengths to accommodate various sized users. In another embodiment, waist belt 102 is adjustable, thereby allowing the user to adjust the length of the belt accordingly for a proper fit around the waist. In one embodiment, waist belt 102 is comprised of canvas, leather, rubber, nylon, bungee, neoprene, elastic, and other synthetic or natural materials/textiles, or any combination of the forgoing, or any suitable materials as would be appreciated by those skilled in the art after having the benefit of this disclosure.

In one embodiment, the waist belt 102 is lightweight and flexible. In one embodiment, waist belt 102 is essentially a flat band and of a width that provides a comfortable fit for the user. In another embodiment, the belt 102 can be of various widths/broadness as well as varying thickness. In another embodiment, the belt can be elasticized and/or semi-rigid.

Figure 2:
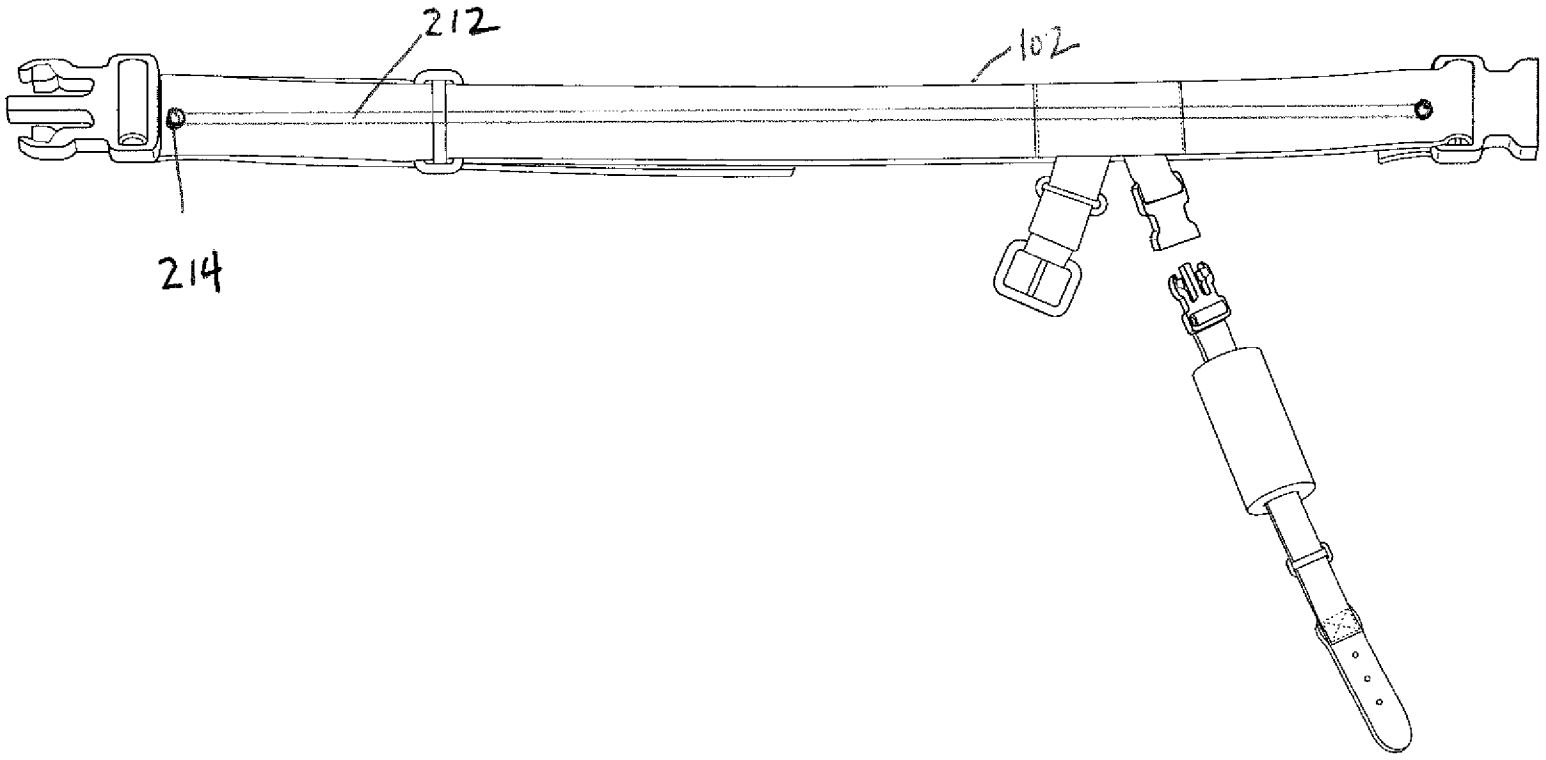
FIG. 2 shows a posterior view of the hip harness.

In one embodiment, FIG. 2 shows waist belt 102 as configured with a weighted feature 212. In one embodiment, weighted feature 212 can be individual weights that can be distributed along all or a portion of waist belt 102. In one embodiment belt 102 is configured with adjustable weight increments, such as one-pound, two-pound or ten-pound increments, although other increments are envisioned. In another embodiment, belt 102 is configured with external pockets to hold weights along belt 102. In another embodiment, pockets are configured with adjustable Velcro closures, or other closure means, such as snaps, to ensure a secure fit. In another embodiment, FIG. 2 shows weighted feature 212 as a weighted band that can be attached to belt 102 by attachment means 214. In one embodiment, attachment means 214 include snaps, but other suitable attachment means such as Velcro or zippers or hook & loop system, or other attachment means as would be appreciated by one skilled in the art having the benefit of this disclosure.

Other suitable weight-storage configurations and attachment means are envisioned. For example, in one embodiment, a 10 lb. belt includes 10-1 lb. weights; in another a 10 lb. belt includes 5-2 lb. flexible weights; in yet another embodiment, a 10 lb. belt includes one 10 lb. weighted band that attaches to belt 102. Weights can be made of various materials, and include plastic, sand bags, and other natural and/or synthetic materials, or any combination of the foregoing.

In one embodiment, thigh strap 104 is removably attached to waist belt 102 by attachment means 110. In one embodiment, attachment means consists of one or more of snaps, Velcro, ties, hook & eye/loop arrangements, buckles, clips or any combination of the forgoing. Thigh strap 104 can be configured in various ways. For example, in one embodiment, thigh strap 104 is a single strap with a first end 112 and a second end 114. In another embodiment, strap 104 is adjustable in length. In one embodiment, first end 112 and second end 114 are configured with attachment means for removable attachment at one or both ends (112/114) of the strap to waist belt 102. In another embodiment, thigh strap 104 can be configured with one end, such as first end 112 of thigh strap 104, proximal to waist belt 102, and permanently secured to the waist belt 102. For example, first end 112 of strap 104 can be permanently secured, such as sewn, to belt 102 so that thigh strap 104 and waist belt 102 are conjoined. In another embodiment, thigh strap 104 can be configured at second end 114, which is distal to first end 112, with attachment means for removable attachment to waist belt 102. In yet another embodiment, each of first end 112 and second end 114 can be permanently attached to belt 102, such as sewn, with attachment means 110 configured on either side of pressure point 106, at some point between pressure point 106 and first end 112 &/or at some point between pressure point 106 and second end 114.

This strap 104 is configured with pressure point feature 106, such as a pressure pad. Pressure point feature 106 can be adjustable so that the pressure point feature 106 can be manipulated, e.g., moved along strap 104, by the user for alignment with the femoral head of the user's hip, when the hip harness is worn by the user. In one embodiment, the pressure point feature 106 is configured to allow strap 104 to pass through the interior of the pressure point feature 106 along its longitudinal axis.

Different sizes and shapes may be used to form the pressure point feature 106. In one embodiment, a larger pressure point feature diameter will provide more depth resistance than a smaller-diameter pressure point feature. In another embodiment, the shape of the pressure pad is cylindrical to allow a user to squat or lunge deeply while keeping a high level of pressure on the hip joint. In another embodiment, the pressure point feature may be of shapes other than cylindrical, such as rectangular, as may be appreciated by those skilled in the art after having the benefit of this disclosure. Pressure point feature 106 can be configured for permanent attachment to strap 104, or for reversible &/or removable attachment to strap 104.

The pressure point feature 106 may be comprised of different materials, such as rubber, foam, gel, plastic, memory materials, rigid materials, flexible materials, natural and/or synthetic materials, and any combination of the foregoing. Other suitable materials may be used as would likely be appreciated by those skilled in the art, after having the benefit of this disclosure.

Figure 3:
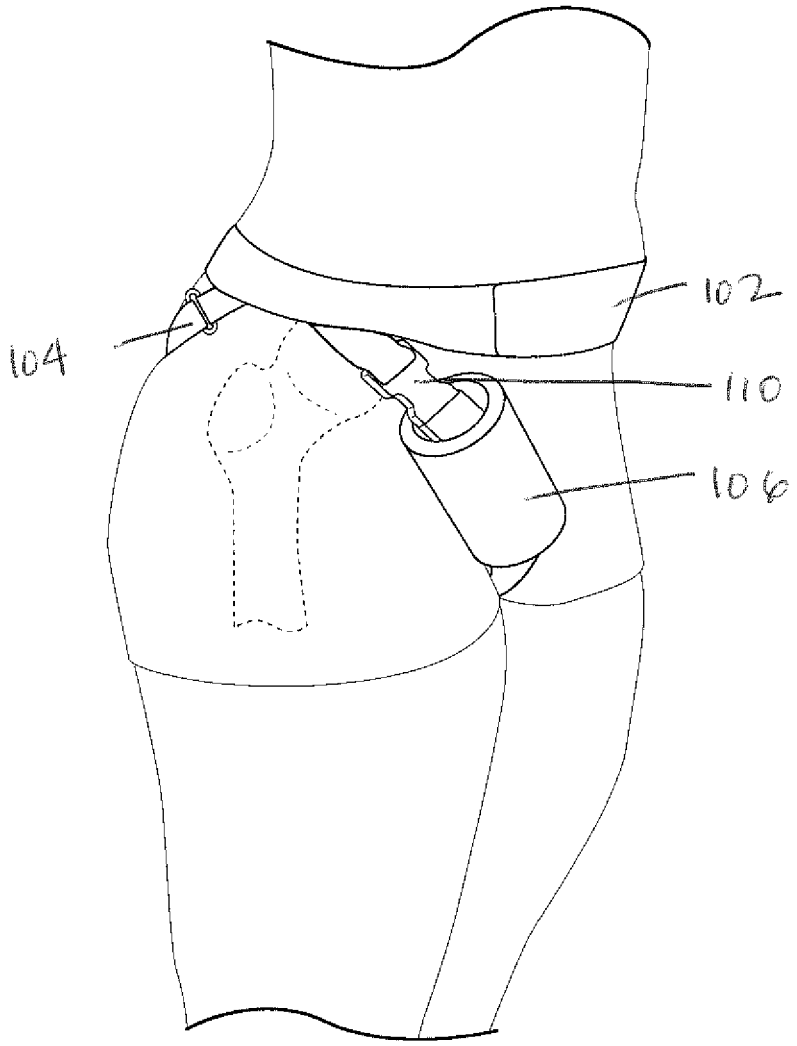
FIG. 3 shows a side view of the hip harness as worn by a user.

Thus, hip harness 100 of this application is configured to align with the femoral head of a user's hip joint for application of pressure, while maintaining its proper anatomic position—i.e., aligned behind the actalum—which in turn reduces labral tears and irritation caused when the user squats or lunges too deeply. Thus, the harness 100 helps hold the femur head posteriorly from shifting forward during a squat or deep lunge, which in turn, may help to prevent labral tears and irritation. Alignment of the hip harness 100 for restraint of the femoral head in its proper position in the hip joint of a user is shown in FIG. 3.

Figure 4:
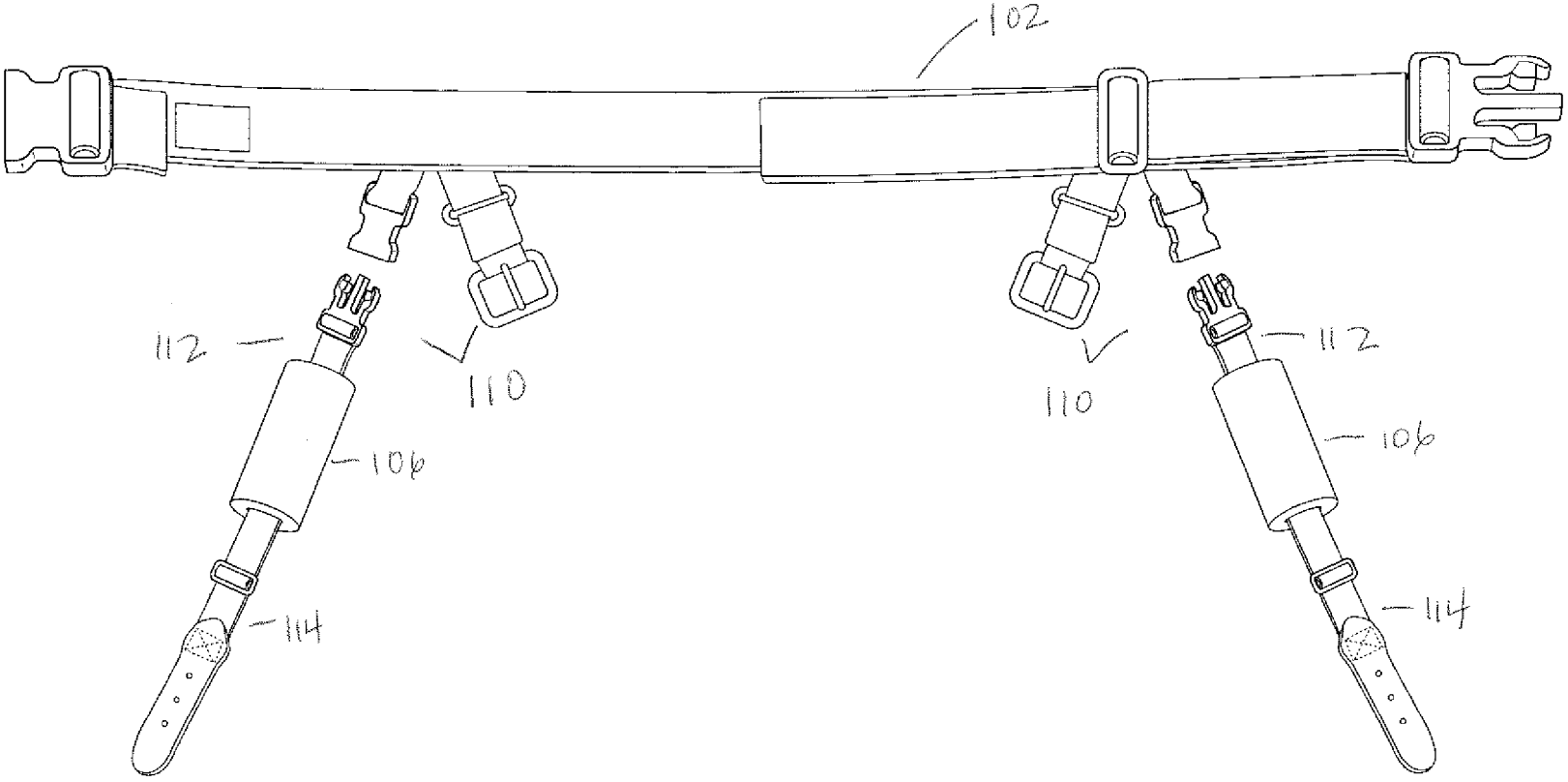
FIG. 4 shows one embodiment of the hip harness as a bilateral configuration.

In one embodiment, two thigh straps may be worn bilaterally on both legs, as shown in FIG. 4.

Figure 5A:
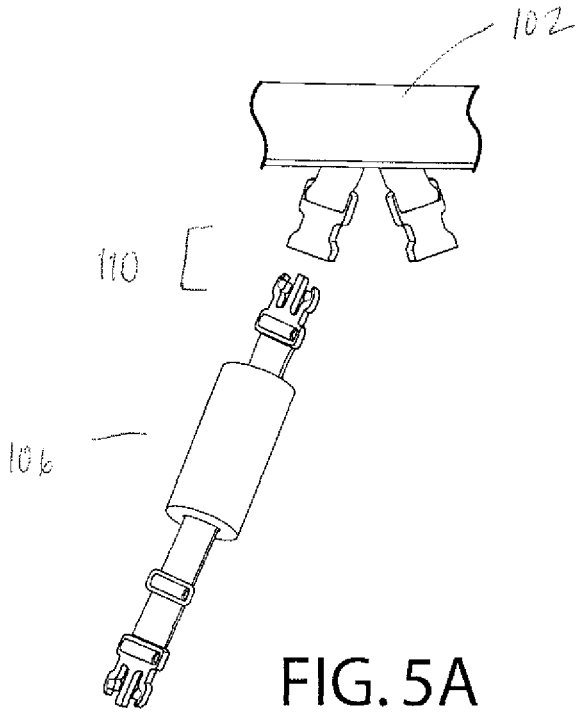
FIGS. 5A and 5B show embodiments of various attachment means for securing the thigh strap to the waist belt.
Figure 5B:
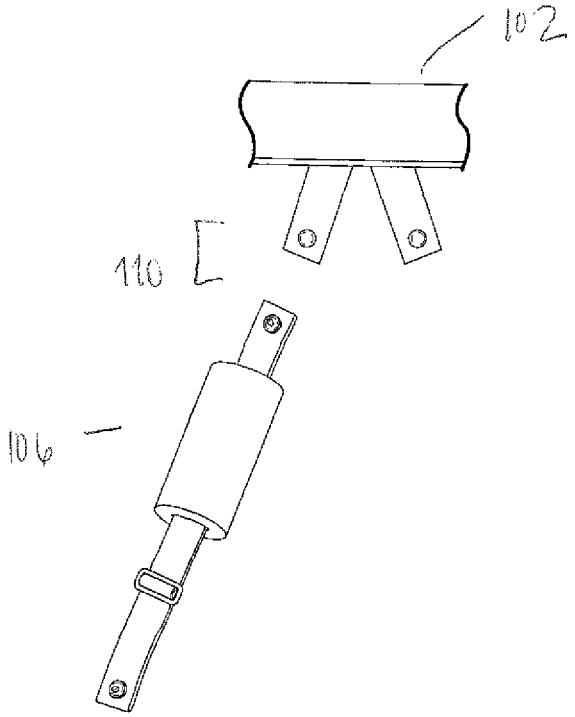

In addition, hip harness 100 may be configured with Velcro, buckles, buttons, or other fastening mechanisms to permit adjustability of the belt and/or thigh strap around the waist and legs, and permit adjustable positioning of the pressure point feature. An example of various attachment means are shown in FIG. 5.

In another embodiment, any or all of a portion of hip harness 100 can be configured with an outer layer or protective covering, such as an anti-slip covering, padded covering, anti-chaffing covering, and/or stain-protectant covering.

In another embodiment, hip harness 100 can be configured with storage compartments, such as pockets, to securely store and hold items, such as keys, money, or other small items for the user's convenience.

It will be understood that various other changes in the details, materials, and arrangements of the parts and steps which have been described and illustrated in order to explain the nature of this invention may be made by those skilled in the art without departing from the principles and scope of the invention as expressed in the subjoined Claims and their equivalents.

The invention claimed is:

1. A hip joint apparatus for athletic training, comprising:

a flexible elasticized primary belt, a flexible singular thigh strap, an adjustable cylindrically-shaped femoral head pressure point feature comprised of a rigid material aligning diagonally along the natural crease from an upper outer thigh region toward an inner pelvic region of a user's body when worn by the user, the pressure point feature exerting direct pressure against an anterior portion of the femoral head of the hip joint when worn by the user, and the cylindrically-shaped femoral head pressure point feature surrounding the thigh strap and the thigh strap passing through the interior of the cylindrically-shaped femoral head pressure point feature along the thigh strap's longitudinal axis, and configured to provide depth resistance, wherein the cylindrically-shaped pressure point feature aligns diagonally between the upper outer thigh region and the pelvis when worn by a user in order to keep the femoral head posterior in the acetabulum when the user squats or lunges during athletic training.

2. The hip joint apparatus of claim 1, wherein the primary belt is an elasticized waist belt for adjustable attachment to the user's waist.

3. The hip joint apparatus of claim 1, wherein the singular thigh strap further comprises attachment means, for adjustable attachment to the primary belt.

4. The hip joint apparatus of claim 1, wherein the cylindrically-shaped femoral head pressure point feature is a pressure pad configured for adjustable attachment to the flexible thigh strap.

5. The hip joint apparatus of claim 1, further comprising a second thigh strap for attachment to the primary belt, independently of the singular thigh strap.

6. The hip joint apparatus of claim 1, further comprising a weighted waist belt.

7. A hip joint apparatus, comprising:

an elasticized primary belt configured for adjustable attachment around the waist of a user;

an adjustable secondary belt configured for adjustable attachment around an upper portion of a thigh of the user;

and a cylindrically-shaped femoral head pressure pad aligning and secured along the adjustable secondary belt at an outer upper thigh region when worn by the user, the cylindrically-shaped pressure pad aligning diagonally along the natural crease from the outer thigh region toward an inner pelvic region of the user's body when worn by the user and is configured for adjustable attachment with the adjustable secondary belt, further configured for surrounding the adjustable secondary belt and allowing the adjustable secondary belt to pass through the interior of the cylindrically-shaped femoral head pressure point feature along the adjustable secondary belt's longitudinal axis, and wherein the cylindrically-shaped pressure pad is comprised of rigid material and aligns diagonally between the upper outer thigh region and the pelvis corresponding to a femoral head region of an anterior portion of the hip joint when worn by the user.

8. The hip joint apparatus of claim 7, further comprising a second adjustable secondary belt to be worn on the opposite thigh of the user, independently of the adjustable secondary belt.

* * * * *